US006322241B1

(12) United States Patent
Hsu et al.

(10) Patent No.: US 6,322,241 B1
(45) Date of Patent: Nov. 27, 2001

(54) MATERIAL VACUUM STIRRING AND DISPERSING DEVICE

(76) Inventors: Shen-An Hsu, No. 168, San-Min Rd.; Cheng-Hui Chen, No. 68, Li-Lin East Rd.; Bor-Jhy Chen, No. 26, Ren-Ai Lane, Te-Sung Rd., all of Chiao-Tou Hsiang, Kaohsing Hsien (TW)

( * ) Notice: Subject to any disclaimer, the term of this patent is extended or adjusted under 35 U.S.C. 154(b) by 0 days.

(21) Appl. No.: 09/461,347

(22) Filed: Dec. 15, 1999

(51) Int. Cl.[7] ..... B01F 13/06; B01F 15/02

(52) U.S. Cl. ..... 366/139; 366/183.1; 366/183.2; 366/289; 366/309; 366/314

(58) Field of Search ..... 366/139, 183.1, 366/183.2, 289, 309, 312, 314, 65, 181.6

(56) References Cited

U.S. PATENT DOCUMENTS 1,320,323 * 10/1919 Drucker et al. .
2,387,488 * 10/1945 Acken et al. .
2,520,957 * 9/1950 Peterson .
2,651,343 * 9/1953 Alexander .
4,190,371 * 2/1980 Durr et al. ..... 366/309
4,302,110 * 11/1981 Niemi .
4,311,397 * 1/1982 Wright ..... 366/309
4,889,432 * 12/1989 Patterson ..... 366/139
4,946,285 * 8/1990 Vennemeyer .
4,955,723 * 9/1990 Schneider .
4,981,365 * 1/1991 Bow et al. .
5,044,761 * 9/1991 Yuhki et al. .
5,145,250 * 9/1992 Planck et al. .
5,636,921 * 6/1997 Murata et al. .
5,833,363 * 11/1998 Gmeiner ..... 366/139

* cited by examiner

*Primary Examiner*—Charles E. Cooley
(74) *Attorney, Agent, or Firm*—Dougherty & Troxell

(57) ABSTRACT

A material vacuum stirring and dispersing device includes a closed container for stirring solid and liquid under vacuum condition, making it possible to stir materials evenly, without forming material balls to enhance the quality of the mixture. The device further includes a material feeder positioned on the closed container for feeding solid or powder materials evenly into the closed container in which is placed the liquid, and a stirring member having a straight shaft extending out and in the closed container with a plurality of stirring leaves fixed on a lower end of the straight shaft in the container. The straight shaft is rotated by a rotating device placed outside of the closed container and is movable up and down as well so as to make the stirring leaves rotate and also move and down to stir completely the solid with the liquid in the closed container.

3 Claims, 5 Drawing Sheets

MATERIAL VACUUM STIRRING AND DISPERSING DEVICE

BACKGROUND OF THE INVENTION

This invention relates to a material vacuum stirring and dispersing device, particularly to one stirring material evenly and preventing it from forming aggregation like balls, upgrading quality of mixed material so as to make it advantageous for subsequent processes.

A known conventional stirring device and mixed material condition are shown in FIGS. 1 and 2. It includes an pen container 1 for stirring and mixing a solid 10 and a liquid 11, but it is often impossible to mix them evenly under disadvantageous exterior environments. In addition, a stirring member 2 rotates with a definite pivot point in the center to stir and mix solid 10 and liquid 11 located near the center of the container 1. Therefore, solid located near the inner wall of the container 1 may be hardly stirred and dispersed, prone to make up aggregation like balls. Besides, mixing materials in the container 1 may be liable to be affected by humidity and temperature of the atmosphere to result in a finished mixture of inferior quality.

In the operating process of the conventional device very tiny miscellaneous matter and dirt 12 in air may easily fall into the container 1, mixing with aggregation like balls formed in the material, particularly mixing in bubbles in the material, resulting in an inferior quality of the finished mixed material, which will be unfavorable for subsequent flowing processes.

For example, in the paint industry, a paint made by mixing various materials with the known conventional method may often contain such miscellaneous mater, dirt 12 and bubbles, making it impossible to completely adhere on the surface of an object such as walls, wood or the like, Or in pharmaceutical industry, medicines have to be mixed absolutely in a very clean sophisticated condition to ensure quality of medicines and the curing effects. Should the medicines made be not very pure by the known conventional device, they may not have effect for curing, but maybe harmful for health. Further, for example in the electronic industry, if the conductive solder used in electronic products should not be god, it would spoil products so that technological makers may lose competitiveness in the market.

SUMMARY OF THE INVENTION

This invention has been devised to offer a vacuum material stirring and dispersing device, which includes a closed container for mixing liquid with solid or powder, a material feeder positioned on the closed container to receive material and let it fall into the closed container, and a mixing member having stirring leaves extending in the center portion or the bottom portion of the closed container for mixing liquid with solid or powder evenly and moving up and down for a certain distance to let the solid be everywhere stirred.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
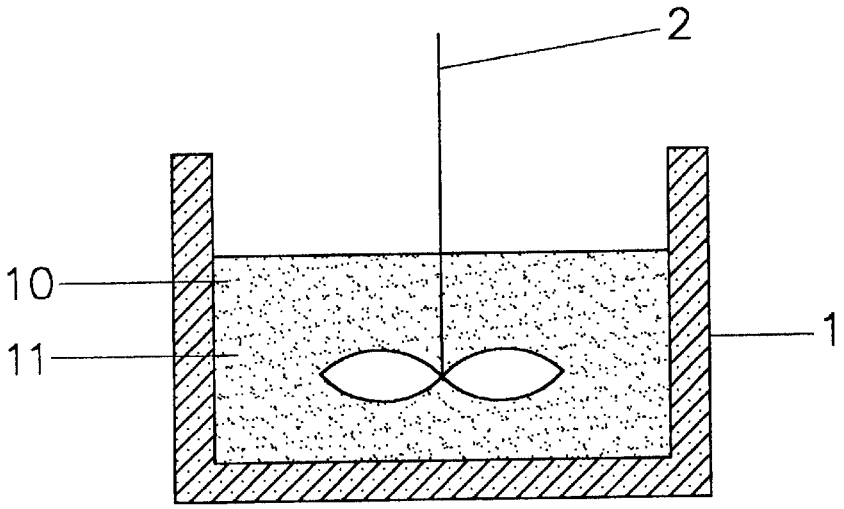
Fig.1 PRIOR ART
FIG. 1 is a side cross-sectional view of a known conventional stirring device.
Figure 2:
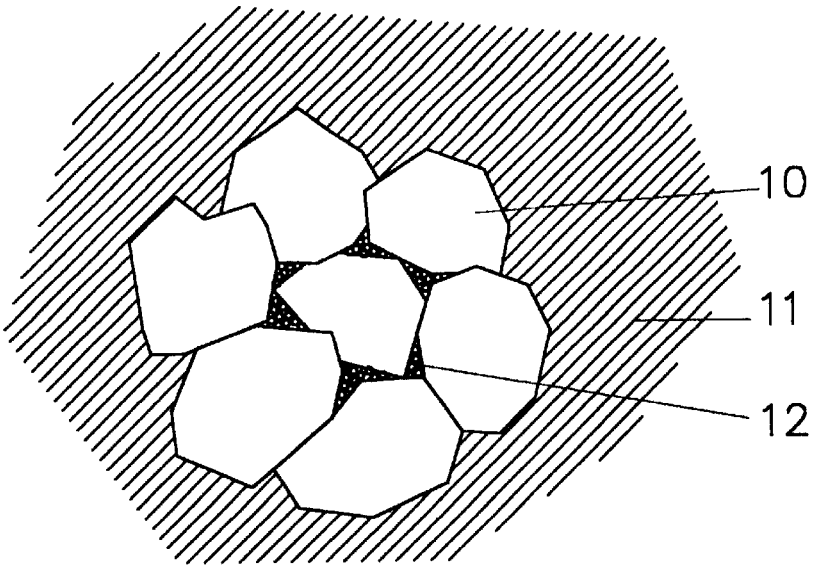
Fig.2 PRIOR ART
FIG. 2 is an upper view of mixed balls formed with solid and liquid in the known conventional stirring device.
Figure 3:
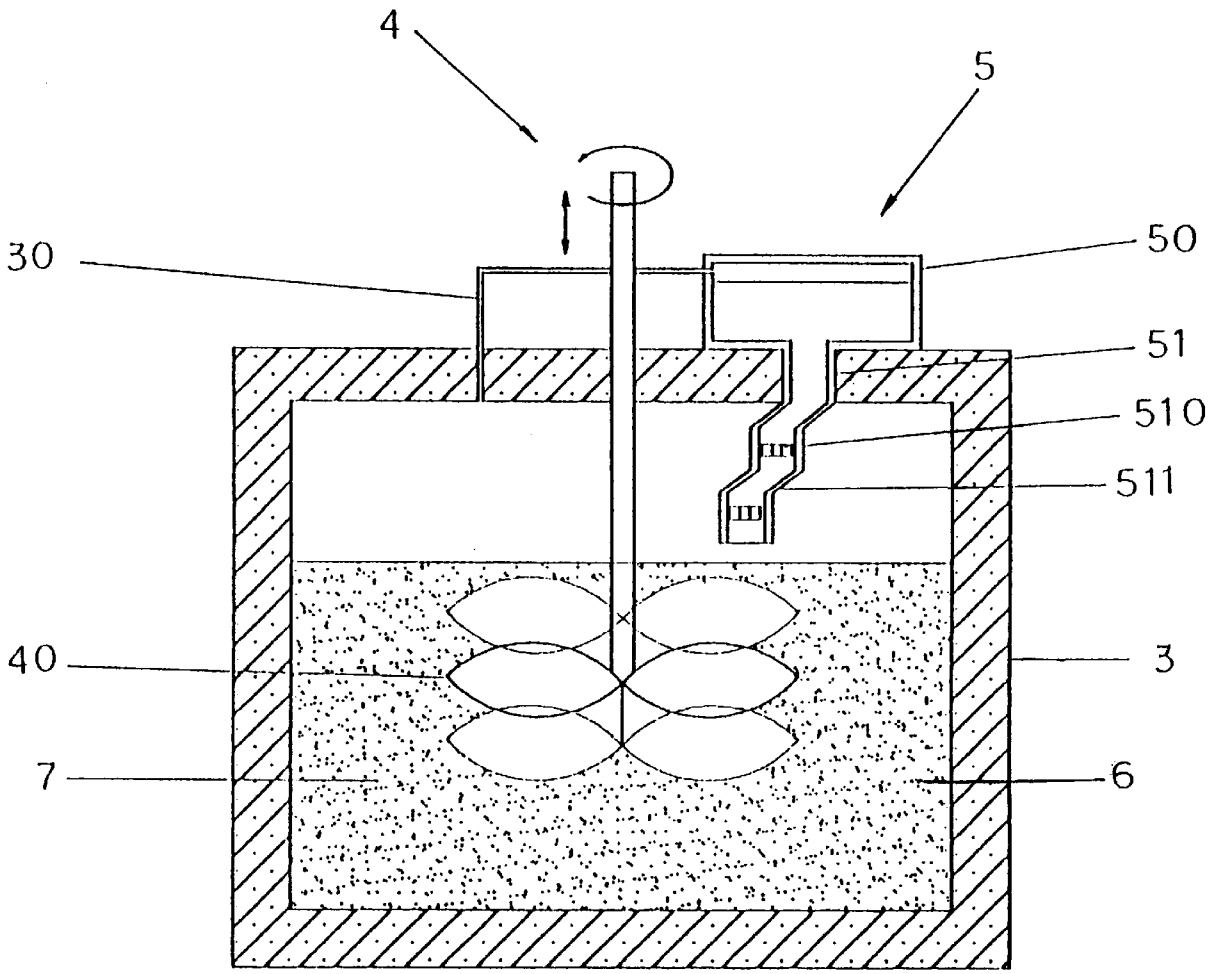
FIG. 3 is a side cross-sectional view of a first preferred embodiment of a material vacuum stirring and dispersing device in the present intention.
Figure 4:
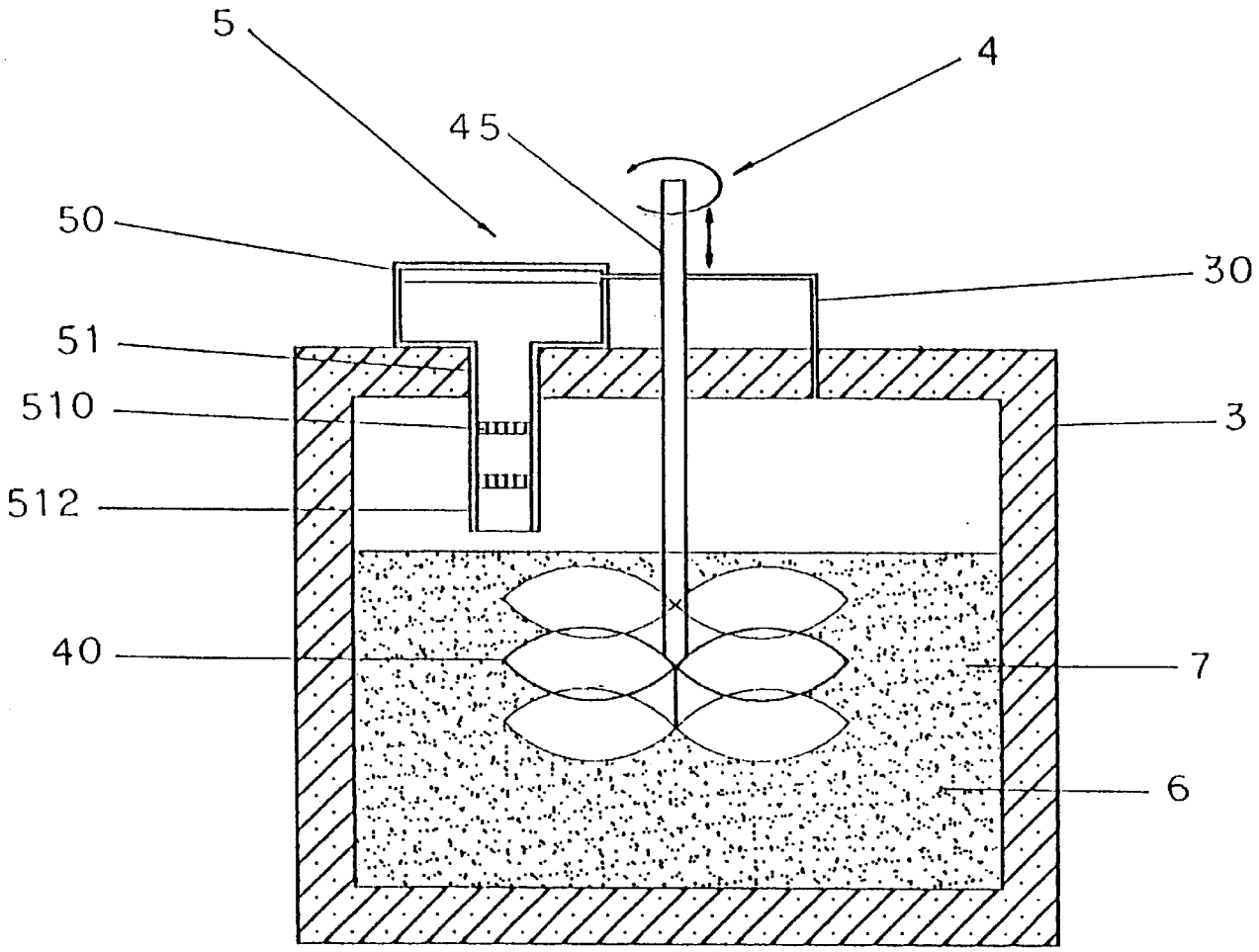
FIG. 4 is a side cross-sectional view of a second preferred embodiment of a material vacuum stirring and dispersing device in the present invention.

A first preferred embodiment of a material vacuum stirring and dispersing device in the present invention, as shown in FIGS. 3 and 4, includes a closed container 3, a material feeder 5, and a stirring member 4 as main components combined together.

The closed container is used for containing a mixture of solid (or powder, and always called solid hereafter) and liquid and kept really or properly vacuum. The vacuum in the container 3 can be adjusted to suit subsequent processes of mixed material after formed, and thus mixed material of liquid and solid may not be affected by humidity and temperature of the atmosphere during stirring and dispersing processes in the container 3, keeping purity and quality of the mixed material formed.

The material feeder 5 is positioned on the closed container 3, placing solid therein to fall into the container 3, having orderly a store room 50 and a guide way 51 extending down to reach the interior of the container 3 from the store room 50, which is for storing solid and is preferably also at a vacuum so as not to downgrade the vacuum in the container after solid is guided to fall down in the container for mixing with liquid placed in the container 3. The guide way 51 is used mainly for guiding solid in the store room 50 into the container 3. Before carrying out mixing, solid and liquid are in advance prepared properly, solid is then loaded in the store room 50 of the material feeder 5, and liquid is poured in the container 3. Next, the container 3 is pumped to become completely or properly vacuum, and then the solid in the store room 50 is gradually made to fall smoothly through the guide way 51 into the container 3 to mix with the liquid therein by stirring process. In order to keep the store room 50 and the container 3 under a constant pressure, a guide tube 30 is connected between the container 3 and the store room 50 so as to permit the solid in the store room 50 smoothly fall down in the container 3.

The guide way 51 is shaped to have a plurality of steps 511 in a sloped condition shown in FIG. 3, or those 512 in a straight condition shown in FIG. 4. Further a sift net 510 is provided on every step in both kinds, sifting out unnecessary or miscellaneous matter from solid 6, and in addition solid 6 may fall down through the sift net 510 balanced and smoothly to melt and mix with the liquid 7 evenly.

FIG. 3 shows the first embodiment having the guide way 51 with steps 511 in the sloped condition as mentioned above, and a hollow space for solid 6 in the store room 50 to fall through down in the closed container 3 by means of a power source or a vibration source. So solid may be dispersed sufficiently during falling down the guide way 511 and with miscellaneous matters sifted off by the sift nets 510, and besides forcing solid 6 to pass through the nets 510 and become smaller to be easily stirred evenly. But of course, trembling process may be preferably better for solid to fall down.

FIG. 4 shows the second embodiment, which has the guide way 51 and the guide way 512 in the straight condition, permitting solid 6 fall down straightly through the sift net 510 into the closed container 3, with the weight of solid producing energy for solid to pass through the nets 510 and become smaller to mix advantageously with the liquid in the container 3.

The stirring member 4 has a straight shaft 45 to extend in and out of the container 3 and plurality of stirring leaves 40 fixed with a lower end of the straight shaft 41 and located in the center portion or the bottom portion of the container 3.

Figure 6:
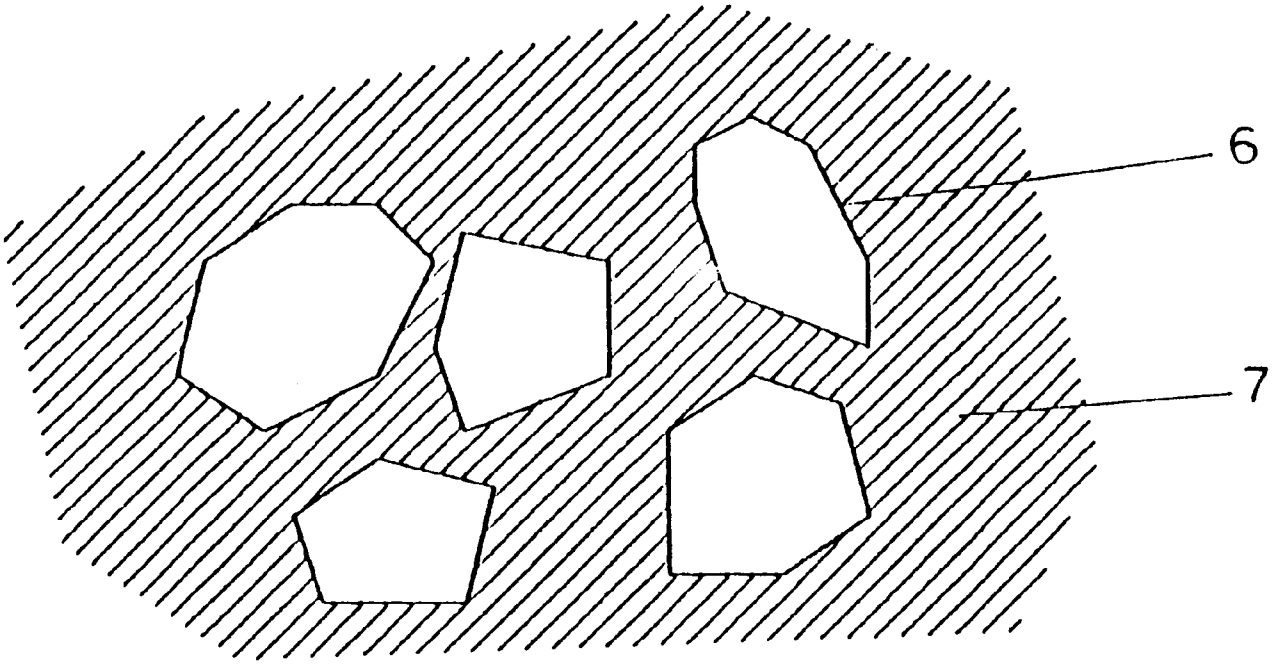

Then the shaft 41 is rotated by means of a power source and also can move up and down for a certain distance to let the stirring leaves 40 also rotate and move up and down to stir liquid and solid to mix together. Then solid 6 located near the inner walls and the bottom of the container 3 can be stirred as well at the same time, so solid at every corner can mixed with liquid, without forming balls, as shown in FIG. 6.

Figure 5:
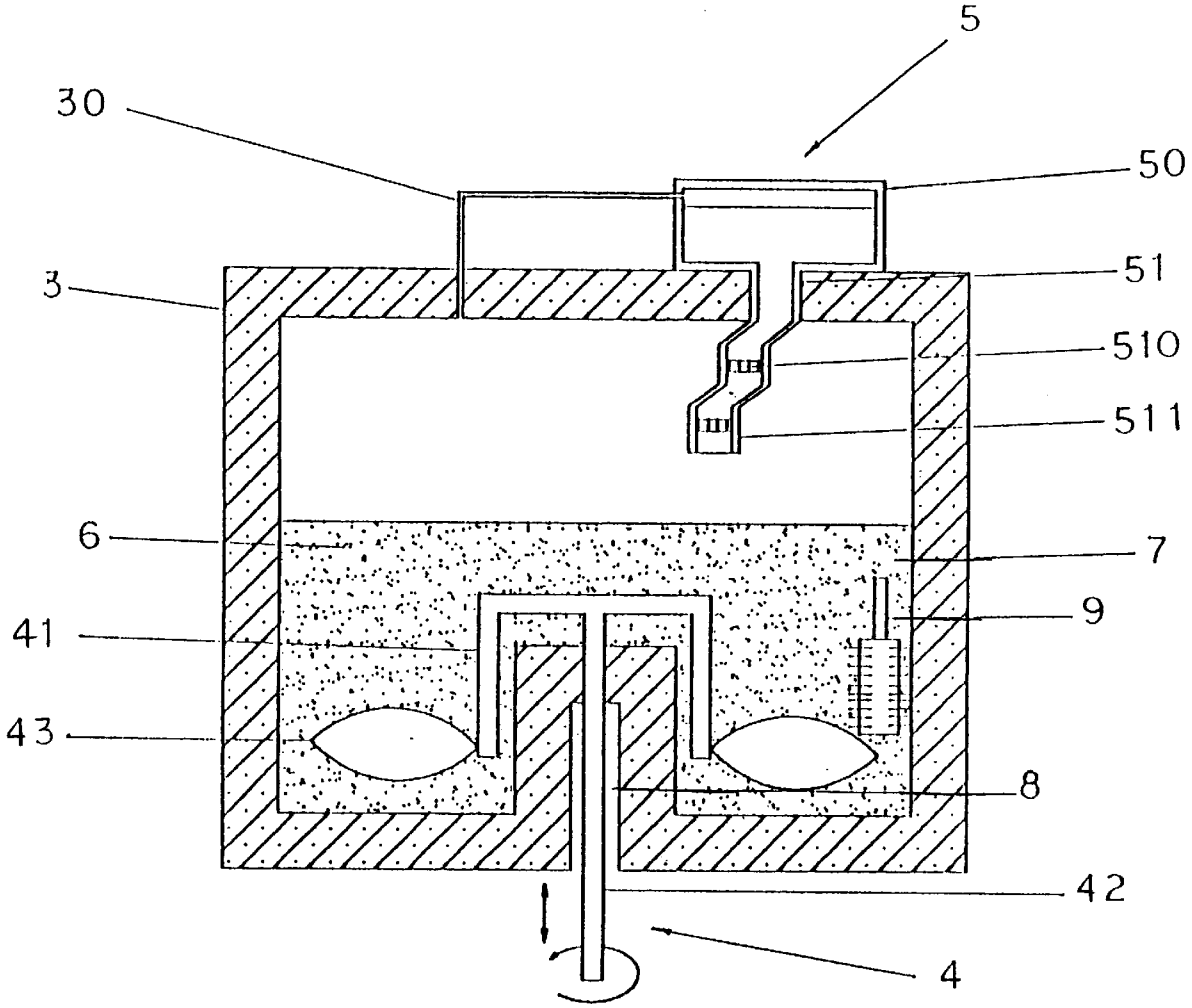
FIG. 5 is a side cross-sectional view of a third preferred embodiment of a material vacuum stirring and dispersing device in the present invention; and, FIG. 6 is an upper view of mixtures formed with solid and liquid in the device in the present invention.

The third embodiment of a material vacuum stirring and dispersing device is shown in FIG. 5, having almost the same structure of the first embodiment, but the stirring member 4 has a straight shaft 42 inserted up through a deep hole 8 defined by a U-shaped wall in the bottom of the container 3 into the interior. An inner end of the shaft 42 fixed with an inverted U-shaped rod 41, which has two ends fixed with a stirring leaf 43. Then the shaft 42 is rotated and moved up and down for a certain distance by a rotating means located outside the container 3, permitting the stirring leaves 43 rotate and move up and down together with the shaft 42 so that solid 6 and liquid 7 in the container 3 may mix enough not to form balls, facilitating subsequent processes, not resulting in unqualified products.

The invention has the following advantages as understood from the above description.

1. When the stirring member rotates for stirring, it also moves up and down for a certain distance, permitting the solid and the liquid in the container 3 to completely mix together, not permitting the solid to form balls or only mixing the solid located in the center portion with solid located near the surrounding wall remaining unmixed.

2. As the container 3 and the store room 50 are kept completely or properly vacuum, mixed material formed by stirring under such vacuum can be guaranteed in quality and purity, and then subsequent processes can be carried out smoothly. A scrap device 9 can be added inside the container 3 for scraping dirty matter adhered on an inner surface of the container 3 for the next stirring action to let mixed material made pure.

3. Both steps 511 and steps 512 of the material feeder 5 have the sift net 510 for sifting solid before it falls down in the container 3, only only getting rid of exterior and miscellaneous mater and dispersing solid sufficiently, enabling the solid to mix with the liquid completely. In addition solid may become smaller when it passes through the shift net 510, which is favorable for stirring evenly.

What is claimed is:

1. A stirring and mixing device for mixing a liquid and a solid, and comprising:

a) an enclosed container having a liquid therein;

b) a stirring device including an elongated shaft extending into the container so as to rotate and to move axially while rotating with respect to the container, a portion of the shaft located in an interior of the container having a plurality of stirring leaves thereon to stir the liquid in the container;

c) a solid material feeder including a storage device storing the solid material located externally of the container, the storage device having a guide way extending into the interior of the container at least when the elongated shaft is rotating and moving axially whereby the solid is introduced into and mixed with the liquid; and d) a guide tube communicating with the interior of the container and an interior of the storage device during rotational and axial movement of the shaft whereby pressure within the storage device is the same as pressure within the container, thereby enabling the solid material to pass through the guide way and into the liquid as the shaft rotates and moves axially, wherein the guide way comprises a plurality of downwardly sloped steps within the container.

2. The stirring and mixing device of claim 1 further comprising at least one sift net located in the guide way.

3. A stirring and mixing device for mixing a liquid and a solid, and comprising:

a) an enclosed container having a liquid therein;

b) a stirring device including an elongated shaft extending into the container so as to rotate and to move axially while rotating with respect to the container, a portion of the shaft located in an interior of the container having a plurality of stirring leaves thereon to stir the liquid in the container;

c) a solid material feeder including a storage device storing the solid material located externally of the container, the storage device having a guide way extending into the interior of the container at least when the elongated shaft is rotating and moving axially whereby the solid is introduced into and mixed with the liquid; and d) a guide tube communicating with the interior of the container and an interior of the storage device during rotational and axial movement of the shaft whereby pressure within the storage device is the same as pressure within the container, thereby enabling the solid material to pass through the guide way and into the liquid as the shaft rotates and moves axially, and further comprising an inverted U-shaped rod on the shaft, the plurality of stirring leaves extending from the inverted U-shaped rod.

* * * * *